US006064944A

United States Patent [19]

Sarda et al.

[11] Patent Number: 6,064,944

[45] Date of Patent: May 16, 2000

[54] METHOD FOR SIMPLIFYING THE MODELING OF A GEOLOGICAL POROUS MEDIUM CROSSED BY AN IRREGULAR NETWORK OF FRACTURES

[75] Inventors: Sylvain Sarda; Bernard Bourbiaux, both of Rueil-Malmaison, France

[73] Assignee: Institut Francias du Petrole, Cedex, France

[21] Appl. No.: 09/000,767

[22] Filed: Dec. 30, 1997

[30] Foreign Application Priority Data

Dec. 30, 1996 [FR] France ..... 96 16331

[51] Int. Cl.[7] ..... G06F 19/00

[52] U.S. Cl. ..... 702/11

[58] Field of Search ..... 702/7, 8, 11, 12, 702/13, 14, 16; 367/72, 73

[56] References Cited

U.S. PATENT DOCUMENTS

| | | | |
|---|---|---|---|
| 4,926,394 | 5/1990 | Doyen | 367/73 |
| 5,038,378 | 8/1991 | Chen | 702/7 |
| 5,416,750 | 5/1995 | Doyen et al. | 367/73 |
| 5,539,704 | 7/1996 | Doyen et al. | 367/73 |
| 5,671,136 | 9/1997 | Willhoit, Jr. | 702/18 |

FOREIGN PATENT DOCUMENTS

| | | |
|---|---|---|
| 2725794 | 4/1996 | France . |
| 2725814 | 4/1996 | France . |
| 2733073 | 10/1996 | France . |

OTHER PUBLICATIONS

Fractured Reservoir Simulation; L. Kent Thomas; Thomas N. Dixon and Ray G. Pierson; Feb. 1983; pp. 42–54.

Implicit Compositional Simulation of Single–Porosity and Dual–Porosity Reservoirs; K.H. Coats; Feb. 1989; pp. 239–275.

A Model for Steady Fluid Flow in Random Three–Dimensional Networks of Disc–Shaped Fractures; Jane C.S. Long, Peggy Gilmour and Paul A. Witherspoon; Aug. 1985; pp. 1105–1115.

Modeling Fracture Flow With a Stochastic Discrete Fracture Network: Calibration and Validation 1. The Flow Model; M.C. Cacas, E. LeDoux, G. DeMarsily; B. Tillie; A. Barbreau; E. Durand, B. Feuga, and P. Peaudecerf; Mar. 1990; pp. 479–489.

(List continued on next page.)

*Primary Examiner*—Donald E. McElheny, Jr.

*Attorney, Agent, or Firm*—Antonelli, Terry, Stout & Kraus, LLP

[57] ABSTRACT

A method of exploring a heterogeneous geological porous original medium, such as a reservoir crossed by an irregular network of fractures, by means of a transposed medium be equivalent to the original medium with respect to a determined type of physical transfer function known for the original medium. The method includes (a) analyzing the original medium to acquire data as to its physical characteristics; (b) forming an image of at least two dimensions of the original medium as an array of pixels, based on the acquired data; (c) associating with each pixel of the array an initial value for the physical transfer function, (d) assigning values for the physical transfer function at each pixel of the array, such as the minimum distance separating the pixel from the nearest fracture, by reference to values of the function assigned to neighboring pixels of the image, (e) determining a physical property of the transposed or equivalent medium by identifying a volume portion of the equivalent medium based on the physical transfer function for the corresponding volume portion of the original medium, and (f) physically exploring the original reservoir based on the determined physical property. The physical transfer function can represent variations between different parts of the original medium, for example distance or transmissivities or heat transfers, such as between a reservoir and a well crossing the reservoir, etc. The method can be applied to determine a transposed medium providing the same recovery of a fluid during a capillary imbibition process as the actual medium.

8 Claims, 5 Drawing Sheets

OTHER PUBLICATIONS

Tools assist in mapping fractured reservoirs; Santiago M. Reynolds; Jun. 1990; pp. 106–111.

Experimental Study of Cocurrent and Countercurrent Flows in Natural Porous Media; Bernard J. Bourblaux and Francois J. Kalaydjian; Aug. 1990; pp. 361–368.

Oil Recovery by Imbibition in Low–Permeability Chalk; Louis Cuiec, Bernard Bourblaux and Francois Kalaydjian; Sep. 1994; pp. 200–208.

The Behavior of Naturally Fractured Reserviors; J.E. Warren and P.J. Root; Sep. 1963; pp. 245–255.

Structural and Tectonic Modelling and its Application to Petroleum Geology; R.M. Larsen, H. Brekke, T.T. Larsen and E. Talleraas; 1992; pp. 364–380.

Typical Features of a Multipurpose Reservoir Simulator; R. Quandalle and J.C. Sabathier; Nov. 1989; pp. 475–480.

METHOD FOR SIMPLIFYING THE MODELING OF A GEOLOGICAL POROUS MEDIUM CROSSED BY AN IRREGULAR NETWORK OF FRACTURES

FIELD OF THE INVENTION

The present invention relates to a method of simplifying modeling of a geological porous medium crossed by an irregular network of fractures which simplify linking fractured reservoir characterization models and dual-porosity models. The method can be implemented, for example, in oil production by reservoir engineers to obtain reliable flow predictions.

BACKGROUND OF THE INVENTION

Fractured reservoirs are an extreme kind of heterogeneous reservoirs, with two contrasted media, a matrix medium containing most of the oil in place and having a low permeability, and a fracture medium usually representing less than 1% of the oil in place and being highly conductive. The fracture medium itself may be complex, with different fracture sets characterized by respective fracture density, length, orientation, tilt and aperture. 3D images of fractured reservoirs are not directly usable as a reservoir simulation input. Representing the fracture network in reservoir flow simulators was long considered as unrealistic because the network configuration is partially unknown and because of the numerical limitations linked to the juxtaposition of numerous cells with extremely-contrasted sizes and properties. Hence, a simplified but realistic modeling of such media remains a concern for reservoir engineers.

The "dual-porosity approach", as taught for example by Warren, J. E. et al "The Behavior of Naturally Fractured Reservoirs", *SPE Journal* (September 1963), 245–255, is well-known in the art for interpreting the single-phase flow behavior observed when testing a fractured reservoir. According to this basic model, any elementary volume of the fractured reservoir is modelled as an array of identical parallelepipedic blocks limited by an orthogonal system of continuous uniform fractures oriented along one of the three main directions of flow. Fluid flow at the reservoir scale occurs through the fracture medium only, and locally fluid exchanges occur between fractures and matrix blocks.

Numerous fractured reservoir simulators have been developed using such a model, with specific improvements concerning the modeling of matrix-fracture flow exchanges governed by capillary, gravitational, viscous forces and compositional mechanisms, and consideration of matrix to matrix flow exchanges (dual permeability dual-porosity simulators). Various examples of prior art techniques are referred to in the following references:

- Thomas, L. K. et al: "Fractured Reservoir Simulation," *SPE Journal* (February 1983) 42–54.
- Quandalle, P. et al: "Typical Features of a New Multipurpose Reservoir Simulator", SPE 16007 presented at the 9th SPE Symposium on Reservoir Simulation held in San Antonio, Tex., Feb. 1–4, 1987; and
- Coats, K. H.: "Implicit Compositional Simulation of Single-Porosity and Dual-Porosity Reservoirs," paper SPE 18427 presented at the SPE Symposium on Reservoir Simulation held in Houston, Tex., Feb. 6–8, 1989.

A problem met by reservoir engineers is to parameterize this basic model in order to obtain reliable flow predictions. In particular, the equivalent fracture permeabilities, as well as the size of matrix blocks, have to be known for each cell of the flow simulator. Whereas matrix permeability can be estimated from cores, the permeabilities of the fracture network contained in the cell, i.e. the equivalent fracture permeabilities, cannot be estimated in a simple way and require taking the geometry and properties of the actual fracture network into account. A method of determining the equivalent fracture permeabilities of a fracture network is disclosed in the parallel patent application EN. 96/16330.

There is known a reference procedure for determining the dimensions a, b of each block of a section crossed by a regular grid of fractures Feq which is equivalent to the section of a natural fractured multi-layered medium crossed by a fracture network FN along a datum plane parallel with the layers (commonly horizontal or substantially horizontal plane). For each layer of the fractured rock volume studied (FIG. 1), the "horizontal" dimensions a, b of the blocks of the equivalent section are determined iteratively by computing and comparing the oil recovery functions versus time R(t) and Req(t) respectively in the real section RE of the fractured rock volume studied and in the section EQ of equally-sized "sugar lumps" equivalent to the distribution of real blocks. This conventional method requires a single-porosity multiphase flow simulator discretizing matrix blocks and fractures in such a way that the recovery curves can be compared. Such a procedure is very costly as the discretization of the real section may involve a very high number of cells. Actually, the real shape of blocks must be represented using thin fracture cells along the boundaries of each block. The matrix must also be discretized with a sufficient number of cells to obtain an accurate block-fracture imbibition transfer function.

Different prior art techniques in the field can be found, for example, in:

- Bourbiaux, B. et al: "Experimental Study of Cocurrent and Countercurrent Flows in Natural Porous Media," SPE Reservoir Engineering (August 1990) 361–368.
- Cuiec, L., et al.: "Oil Recovery by Imbibition in Low-Permeability Chalk," SPE Formation Evaluation (September 1994) 200–208.

However no use of the specific imbibition features has yet been made to find dimensions of the equivalent block in dual-porosity models. So reservoir engineers lack of a systematic tool for computing dimensions of a parallelepipedical block which is equivalent for multiphase flows to actual distribution of blocks in each fractured reservoir zone.

Techniques for integrating natural fracturing data into fractured reservoir models are also known in the art. Fracturing data are mainly of a geometric nature and include measurements of the density, length, azimuth and tilt of fracture planes observed either on outcrops, mine drifts, or cores or inferred from well logging. Different fracture sets can be differentiated and characterized by different statistical distributions of their fracture attributes. Once the fracturing patterns have been characterized, numerical networks of those fracture sets can be generated using a stochastic process respecting the statistical distributions of fracture parameters. Such processes are disclosed, for example, in patents FR-A-2, 725, 814, 2, 725, 794 or 2, 733, 073 of the applicant.

SUMMARY OF THE INVENTION

The method according to the present invention provides a simplified modeling of an heterogeneous geological porous original medium (such as, for example, a reservoir crossed by an irregular network of fractures) as a transposed or equivalent medium in order that the transposed medium be equivalent to the original medium regarding a determined type of physical transfer function known for the transposed medium, the method comprising:

forming an image of at least two dimensions of the geological medium as an array of pixels, and associating with each pixel of the array a particular initial value for said function, step by step determining a value to assign for the physical transfer function at each pixel of said array, by reference to values of the function assigned to neighboring pixels of the image; and determining a physical property of the transposed or equivalent medium by identifying values of the transfer function known for the (simplified) transposed medium with the step by step determined value of the transfer function for the original medium.

The physical transfer function can represent variations between different parts of the geological medium, for example of distances or transmissivities or heat (such as heat transfer between between a reservoir and a well crossing the reservoir), or any mass flow transfer between different parts of the geological medium, etc.

The method can be applied, for example, to determine from an image of an actual geological porous medium crossed by a irregular network of fractures a transposed medium, including a set of regularly disposed blocks separated by a regular grid of fractures, which transposed medium provides substantially the same recovery of a fluid during a capillary imbibition process as the actual medium, the method comprising:

forming an image of at least two dimensions of the actual medium as an array of pixels;

determining for each pixel the minimum distance separating the pixel from the nearest fracture;

forming a distribution of numbers of pixel versus minimum distances to the fracture medium, and determining therefrom the recovery function (R) of said set of blocks and determining dimensions (a,b) of the equivalent regular blocks of the set from the recovery function (R) and from the recovery function (Req) of the equivalent (using e.g. a procedure of identification of said recovery functions).

With the method as defined above, using the pixel representation of the medium, many different transfer functions through any type of heterogeneous medium can be easily and quickly computed.

The geometrical method, for example, finds equivalent block dimensions which enable a very good match of the imbibition behavior of the real block or distribution of real blocks, whatever be the block shape(s) considered. The oil recovery curve computed on the equivalent block section, though simplified with respect to the prior methods, is always very close to that computed on the real block section.

BRIEF DESCRIPTION OF THE DRAWINGS

Other features and advantages of the method according to the invention will be clear from reading the description hereafter of embodiments given by way of non limitative examples, with reference to the accompanying drawings where.

DESCRIPTION OF THE PREFERRED EMBODIMENTS

A new simplified procedure for calculating the dimensions of the block section equivalent to the "horizontal" section of a natural fractured medium is hereafter presented.

Firstly, it must be mentioned that, following the assumption of "vertical" fractures, i.e. perpendicular to the bedding planes, the matrix medium is continuous from one geological layer to another, and the problem of finding equivalent block dimensions becomes two-dimensional. Hence, the problem addressed here is that of determining the equivalent square or rectangular section of numerical matrix blocks for each layer or group of layers having similar fracturing properties.

Secondly, the equivalence of a dual-porosity model to a fractured reservoir has to be established with regard to flow behaviour. Flows in fractured oil reservoirs are essentially multiphase during field exploitation, with two major drive mechanisms for matrix oil recovery, capillary imbibition and gravity drainage. Both mechanisms conjugate their effects in case of water-oil recovery processes which remain a predominant strategy in the development of many fractured reservoirs. Compositional mechanisms such as diffusion are also involved in gas recovery processes. Therefore, the geometrical method described hereafter for determining an equivalent block is based on multiphase flow concepts.

Figure 1:
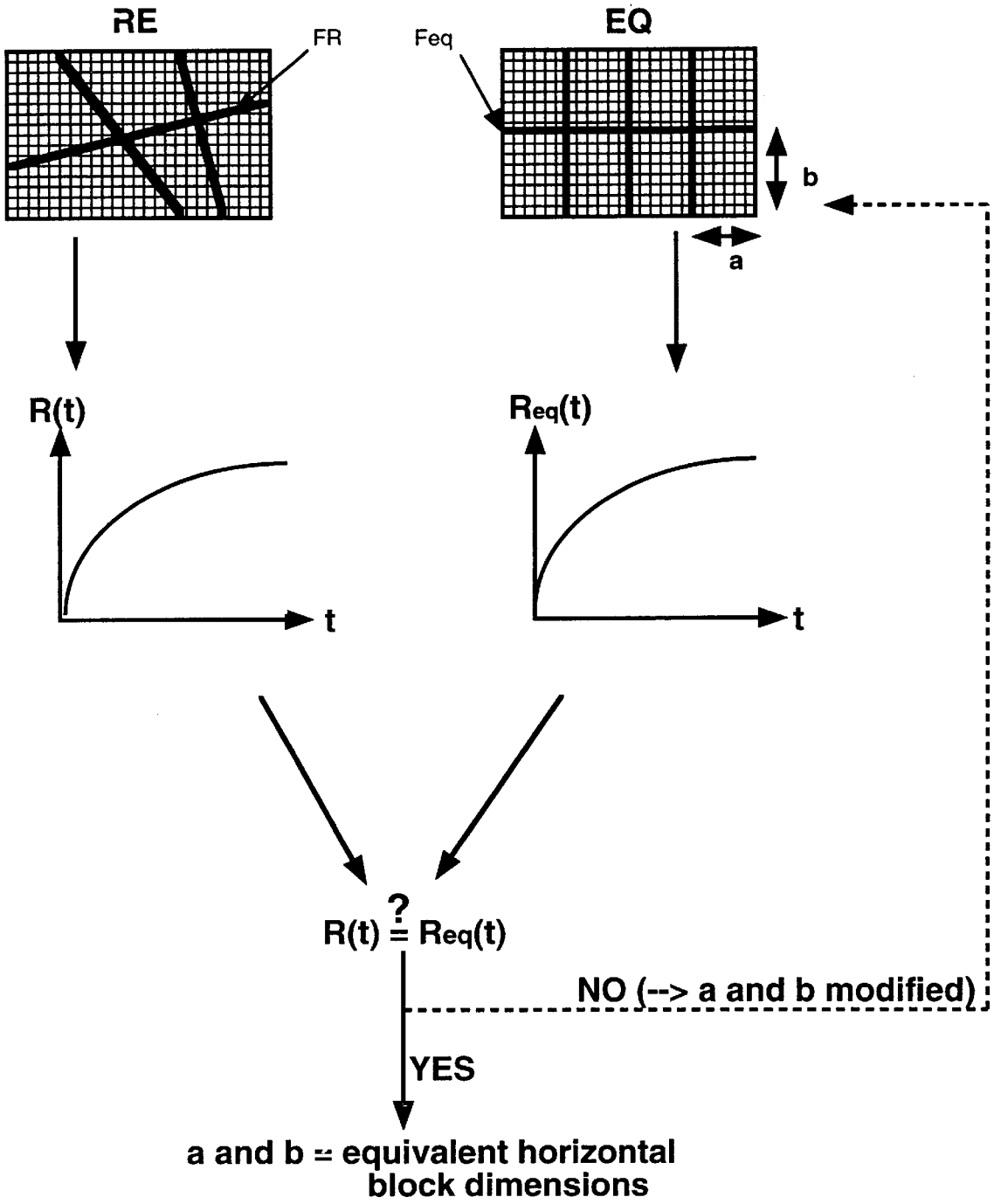
FIG. 1 illustrates a known procedure for determining a regularly fractured medium equivalent to a real fractured medium.
Figure 2:
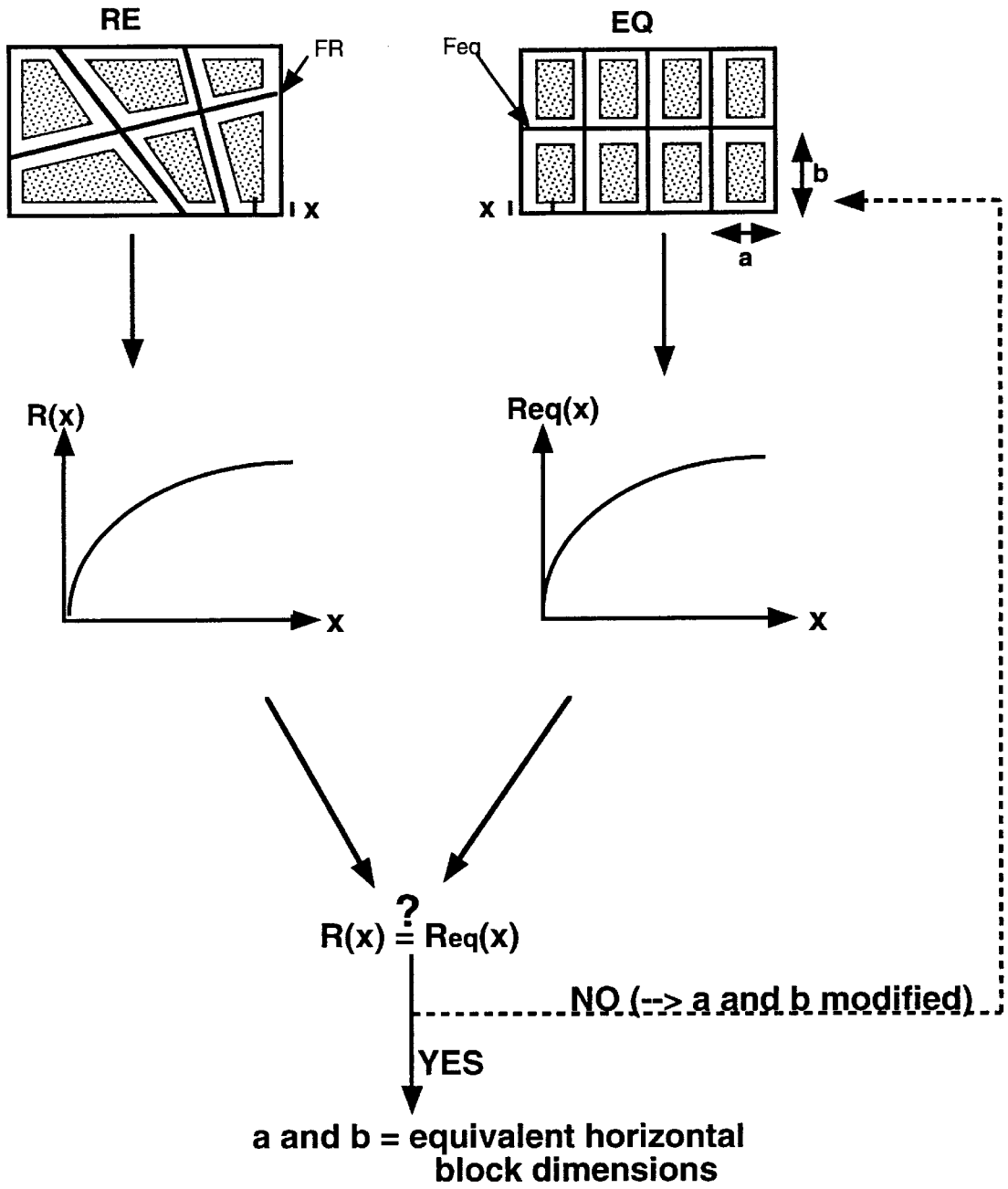
FIG. 2 illustrates a procedure according to the invention for determining a regularly fractured medium equivalent to a real fractured medium.
Figure 9:
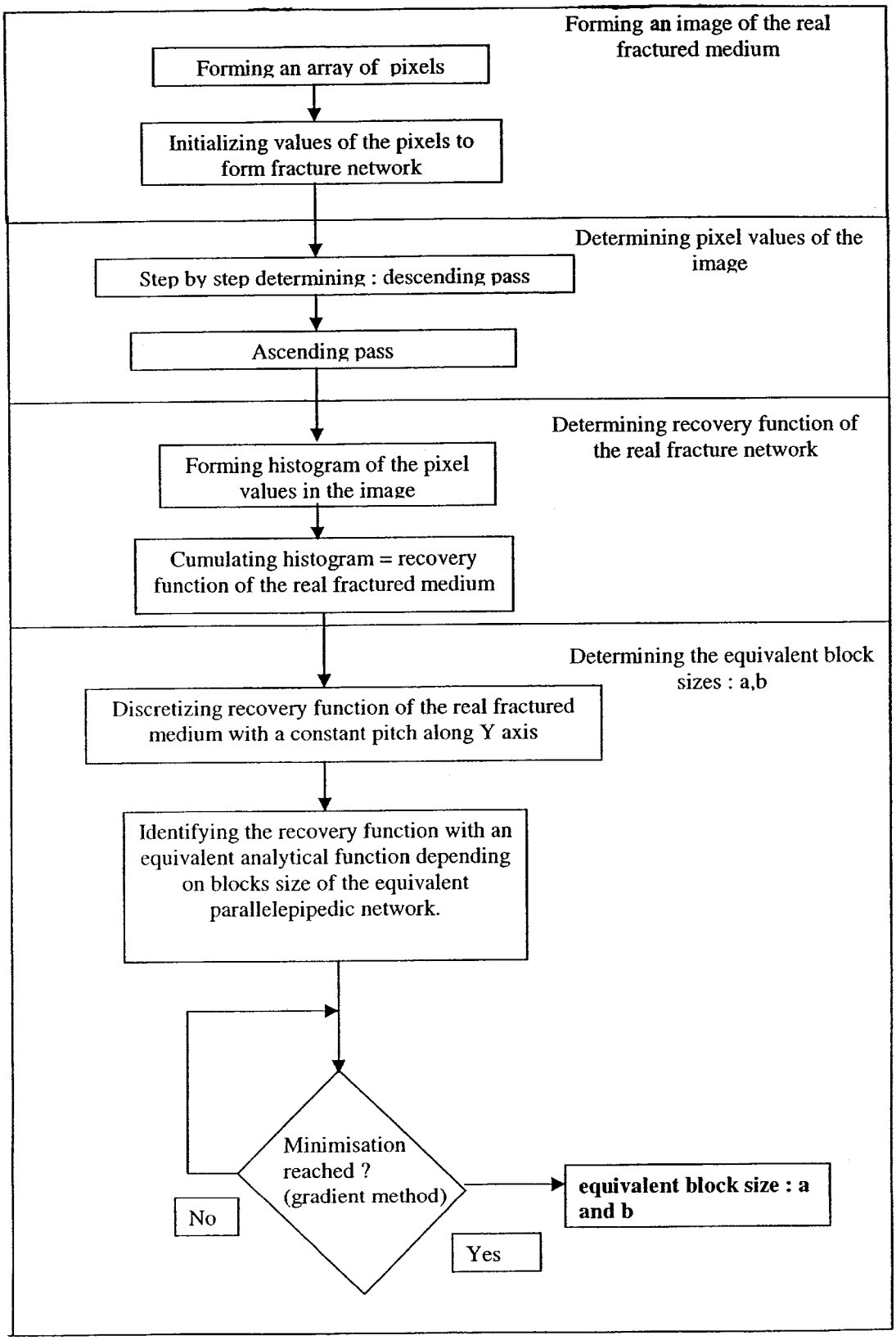
FIG. 9 is a flow chart of a procedure in accordance with the invention.

An embodiment of the method will be described hereafter in relation to FIG. 2, which consists in substantially matching the oil recovery function R(t) of the actual fractured medium resulting from the cited reference method, with the known recovery function Req(t) for the transposed medium, for a diphasic water-oil imbibition process (during a water-oil capillary imbibition drive mechanism), and in relation to FIG. 9, which consists of a flowchart illustrating the method of the invention. This matching is made for each layer of the fractured medium and then for assemblies of n layers. In this case the resultant recovery function R(t) is the sum of the different functions Rn(t) of the n layers weighted by the corresponding thicknesses Hn. Fractures being vertical, only the horizontal dimensions of the equivalent block are determined. Fitting functions R(t) and Req(t) is then a two-dimensional problem.

1) Geometrical Formulation

Fractures being defined by the coordinates of their limit points on a two-dimension section XY of a layer, the imbibition process by which water stands in fractures while oil stands in the matrix blocks has to be determined. Invasion of the matrix by water is supposed to be piston-type. Function x=f(t) linking movement of the water front with time is assumed to be the same for all matrix blocks whatever be their shape and for all elementary blocks. Consequently, fitting functions R(t) and Req(t) is equivalent to fitting functions R(x) and Req(x). These functions physically define normalized areas invaded by water depending on the movement of the imbibition front in the fractured medium.

In two-dimensions, the analytical expression of Req(x) is as follows:

$$\begin{cases} \left\{ Req(x) = 1 - \frac{1}{a \times b}(a - 2x)(b - 2x) = 2\left(\frac{1}{a} + \frac{1}{b}\right)x - \frac{4}{a \times b}x^2, \right. \\ \qquad x \in \left[0,\ \min\left(\frac{a}{2}, \frac{b}{2}\right)\right] \\ \qquad Req(x) = 1,\ x > \min\left(\frac{a}{2}, \frac{b}{2}\right) \end{cases}$$

where a and b are the dimensions of the equivalent rectangular or square block (a and b >0):

Function R(x) has no analytical expression. It is computed from a discretization of the section XY of the layer studied according to the algorithm defined hereafter.

2 Function R(x) Computing Algorithm

The section XY of the layer studied is regarded as an image, each pixel of which represents a surface element. These pixels are regularly spaced by a pitch dx in the direction X and dy in the direction Y. The algorithm implemented aims to determine, for each pixel of this image, the minimum distance separating the pixel from the nearest fracture.

The image is translated into a table of real numbers with two dimensions: Pict[0: nx+1, 0: ny+1] where nx and ny are the numbers of pixels of the image in directions X, and Y respectively. In practice, the total number of pixels (nx.ny) is, for example, of the order of one million. The values of the elements of table Pict are the distances sought.

Initialization

All the pixels through which a fracture passes are at a zero distance from the nearest fracture. For these pixels, table Pict is thus initialized at the value 0. This is done by means of an algorithm known in the art (the Bresline algorithm, for example) which is given the coordinates of the pixels corresponding to the two ends of a fracture regarded as a segment of a line and which initializes (at 0 in the present case) the nearest pixels. The other elements of Pict are initialized at a value greater than the greatest distance existing between two pixels of the image. This value is, for example, nx.dx+ny.dy.

Computation

For a given pixel, computation of the distance sought to the nearest fracture is performed from distance values that have already been computed for the neighboring pixels. A value which, if it is lower than the value initially assigned thereto, is the minimum of the values of the neighboring pixels to which the distance of these pixels from that considered is added, is assigned thereto.

Figure 3:
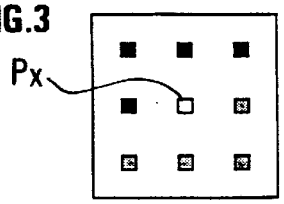
FIG. 3 shows an example of pixel neighboring involved in the computation of a value assigned to a pixel.

This computation is performed in two successive stages. During the descending pass, the image is scanned line by line, downwards and from left to right (from Pict[1,1] to Pict[nx, ny]). Then, during the ascending pass, the image is scanned from the bottom up and from left to right (from Pict[nx, ny] to Pict[1,1]). The pixels that are taken into account are different according to whether the pass is descending or ascending. As shown in FIG. 3, the black and the shaded pixels are those which are taken into account respectively during the descending passes and the ascending passes for pixel Px.

The oblique distance dxy being defined as:

$$dxy = \sqrt{dx^2 + dy^2},$$

the algorithm is written

```
for j=1 to ny
| for i=1 to nx
| | Pict[i,j] = min (     Pict[i−1,j] + dx,          :descending pass
| |                       Pict[i−1,j−1] + dxy,
| |                       Pict[i,j−1] + dy,
| |                       Pict[i+1,j−1] + dxy,
| |                       Pict[i,j])
| end of loop on i
end of loop on j
for j=ny to 1,
| for i=1x to 1,
| | Pict[i,j] = min (     Pict[i+1,j] + dx,          :descending pass
| |                       Pict[i+1,j+1] + dxy,
| |                       Pict[i,j+1] + dy,
| |                       Pict[i−1,j+1] + dxy,
| |                       Pict[i,j])
| end of loop on i
end of loop on j.
```

Histogram

From the table Pict thus computed, a histogram can be drawn by classifying the non zero values (those assigned to the pixels outside the fractures) in increasing order.

The cumulated result of this histogram gives, for any distance delimiting two intervals of the histogram, the number of non zero pixels whose value is lower than this distance. In the described application to a fractured porous medium where this distance corresponds to the movement of the water front, the cumulative result of the histogram thus indicates the area invaded by water. Curve R(x) is obtained by dividing this cumulative result by the total number of non zero pixels (in order to normalize it). The number of intervals used on the abscissa for the histogram corresponds to the number of discretization points of curve R(x). It is selected equal to 500, for example.

3 Seeking the Equivalent Block Dimensions

At this stage, function R(x) is known, and the parameters $(\bar{a}, \bar{b})$ (block dimensions) which minimize the functional are sought:

$$J(a, b) = \sum_{i=1}^{N} (R(x_i) - Req(a, b, x_i))^2$$

where N is the number of discretization points of R(x) and $(x_i)$ are the abscissas of these discretization points.

Discretization Along the Ordinate of R(x)

Figure 5:
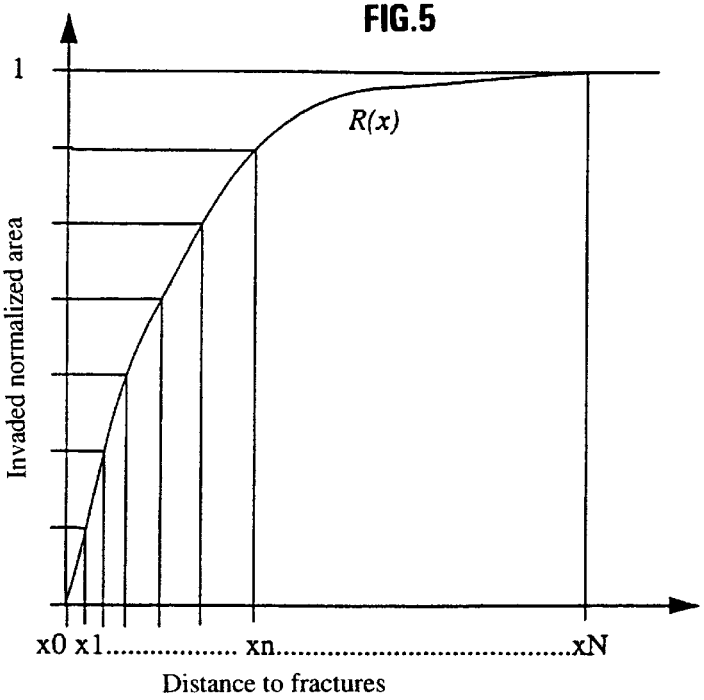
FIG. 5 shows a possible variation of normalized invaded area as a function of distance to fractures.
Figure 8:
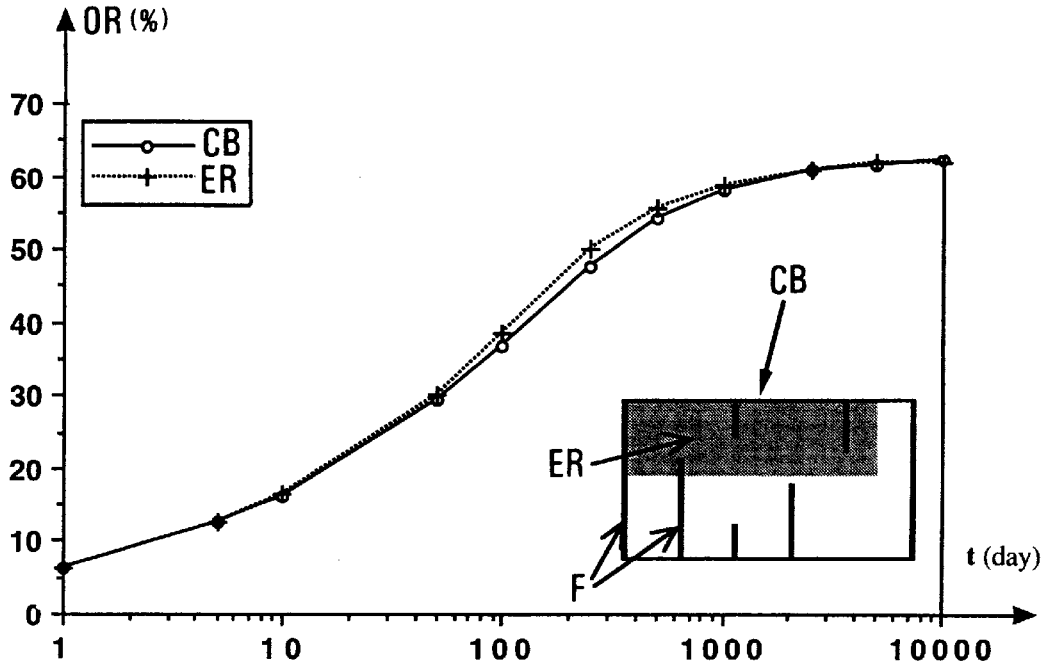
FIG. 8 shows for purpose of validation the good matching between two oil recovery curves OR(t), determined using on the one hand a real "comb-shaped" block, and on the other hand an equivalent rectangular block.

In order to give the same weight to all the volumes of oil recovered during imbibition, curve R(x) is rediscretized with a constant pitch on the ordinate axis (FIG. 5). The sequence $(x_i)$ used by the functional is deduced from this discretization.

Functional Minimization

Since a and b play symmetrical parts in the expression Req(a,b,x), the following functional is actually used:

$$\tilde{J}(u, v) = \sum_{i=1}^{N} (R(x_i) - R\tilde{e}q(u, v, x_i))^2$$

with $$\begin{cases} R\tilde{e}q(u, v, x) = u \times x + v \times x^2 \\ R\tilde{e}q(u, v, x) \leq 1 \end{cases},$$

$$\text{i.e.} \begin{cases} u = 2 \times \left(\frac{1}{a} + \frac{1}{b}\right) \\ v = \frac{-4}{a \times b} \end{cases}$$

Minimization of this functional amounts to finding the pair $(\bar{u}, \bar{v})$ for which $\tilde{J}'(\bar{u}, \bar{v})=0$. This is done by means of a Newton algorithm.

The pair $(\bar{a}, \bar{b})$ sought is thereafter deduced from $(\bar{u}, \bar{v})$. Three cases may arise:

1) v>0 means that one of the values of the pair $(\bar{a}, \bar{b})$ is negative, which has no physical meaning. Let then v=0 in the expression of $R\tilde{e}q(u,v,x)$, which implies that the fractures are parallel. The operation is repeated and the pair $(\bar{a}, \bar{b})$ is computed as follows:

$$\begin{cases} a = \frac{2}{\bar{u}} \\ \bar{b} \text{ inf } ini \end{cases}$$

2) the case $\bar{u}^2+4\bar{v}<0$ is also physically meaningless since it means that $(\bar{a}, \bar{b})$ are not real. Let then $u^2+4v=0$, which means that the elementary block sought has the shape of a square (a=b). After minimization, the pair $(\bar{a}, \bar{b})$ is computed as follows:

$$\begin{cases} \bar{a} = \frac{4}{u} \\ \bar{b} = \bar{a} \end{cases}$$

3) For the other values of pair $(\bar{u}, \bar{v})$, we have:

$$\begin{cases} \bar{a} = \frac{-\bar{u} + \sqrt{\bar{u}^2} + 4\bar{v}}{\bar{v}} \\ \bar{b} = \frac{-\bar{u} - \sqrt{\bar{u}^2 + 4\bar{v}}}{\bar{v}} \end{cases}$$

Validation of the Geometrical Method

Figure 7:
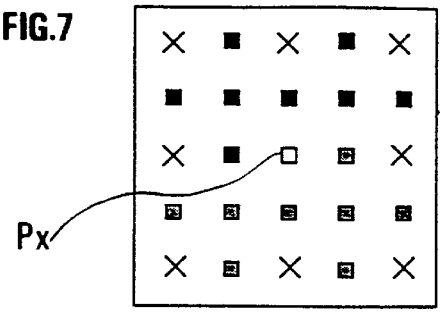
FIG. 7 shows possible enlarged pixel neighboring to improve computation of a value assigned to a pixel.
Figure 4:
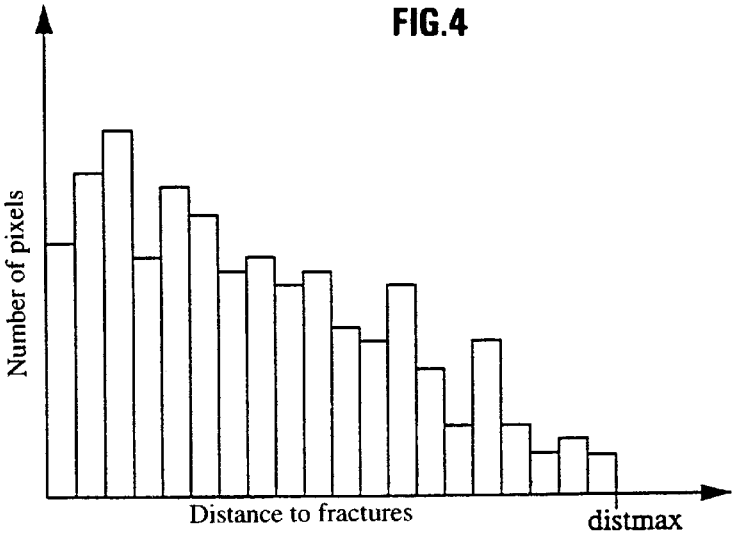
FIG. 4 shows an histogram of a possible distribution of pixels with respect to distance to fractures.

The geometrical method based on the assumptions stated before has been validated against a conventional and very costly reference method based on multiphase flow simulators which requires a single-porosity multiphase flow simulator discretizing matrix blocks and fractures in such a way that the recovery curves can be compared. Conventional two-phase flow simulations have been performed to validate the solutions provided by the geometrical method. The validation can include the following steps:

a. Compute the oil recovery function $R_{re}(t)$ for the real (geologic) section with the conventional method (reference solution);

b. Apply the geometrical method to the real section, which provides a solution (a,b);

c. Using the conventional method again, compute the oil recovery function $R_{eq}$ (t) on the equivalent block section of dimensions (a,b) previously determined, and compare it with the reference oil recovery function $R_{re}(t)$.

d. The geometrical method finds equivalent block dimensions which enable a very good match of the imbibition behavior of the real block, whatever the block shape considered. The oil recovery curve computed on the equivalent block section is always very close to that computed on the real block section as shown on FIG. 7.

Other Applications of the Method

Precision of Computation of the Distances to the Fractures

In the algorithm used to compute the distances of the pixels to the fractures from the two dimensional image, the computing precision can be improved by taking account of a larger number of neighbors of the pixel considered.

In order to increase precision even further, the zone of influence of the pixels can be increased further (to 3 lines and 3 columns or more). In practice, for the use presented above, such an extension provides no notable improvement of the final results.

Figure 6:
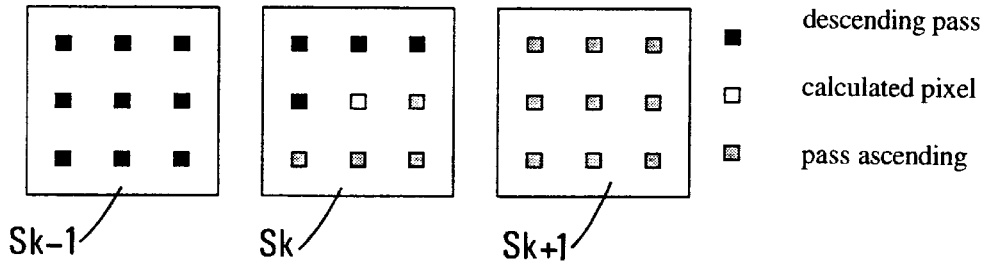
FIG. 6 shows another pixel neighboring in three different planes Sk−1, Sk and Sk+1 involved in a three dimensional computation of values assigned to a pixel.

The algorithm presented above can be applied to a volume. In this case, each pixel represents a volume element. Table Pict is replaced by a three-dimensional table Pict3D[0:nx+1,0:ny+1,0:nz+1] where nx, ny and nz are the numbers of pixels along X, Y and Z, respectively. For computation in a Px of the horizontal plane number k, the pixel neighboring taken into account during descending and ascending passes is represented in FIG. 6. Similarly, the black and the shaded pixels are those which are taken into account respectively during the descending passes and the ascending passes, those indicated by a cross being eliminated for redundancy reasons.

Extension to any Function

In the example that has been developed of the study of a two-phase imbibition phenomenon (water-oil, for example), we have tried to determine the size of the blocks in relation to the distance of the points to the nearest fracture. The geometrical method according to the invention can also be used for other transfer types between two contrasted media such as, for example, heat transfer between a well and a reservoir. But, above all, the "distance between pixels" function used in the previous algorithm can be replaced by any function connecting the points of the image. The value of this function between this pixel and the neighboring pixels taken into account for computation must then be known for any pixel of the image. This function can, for example, give the transmissivity values between the grids of a reservoir whose centres are the pixels of the image.

In such a case, the two ascending and descending passes performed in the algorithm can turn out to be insufficient to find a minimum value at any pixel of the image. The operation is then repeated until the calculated values no longer change.

By taking up the notations presented above and assuming that function F(ij,k,l) returns the value of the function between pixels (i,j) and (k,l), the two dimensional algorithm becomes:

```
change=right
as long_as (change==right)
      change=wrong
      for j = 1 to ny
| for i=1 to nx
|    temp = Pict[i,j]
|       Pict[i,j] = min(Pict[i−1,j]+F(i,j,i−1,j),:descending pass
| |                 Pict[i−1,j−1] + F(i,j,i−1,j−1),
| |                 Pict[i,j−1] + F(i,j,i,j−1),
| |                 Pict[i+1,j−1] + F(i,j,i+1,j−1),
| |                 Pict[i,j]
| |   if (Pict[i,j] <> temp) changes = right
| end of loop on j
end of loop on j
      for j = ny to 1,−1
| for i = nx to 1,−1
|    temp = Pict[i,j]
|       Pict[i,j] = min(Pict[i+1,j] + F(i,j,i+1,j),:descending pass
| |                 Pict[i+1,j+1] + F(i,j,i+1,j+1),
| |                 Pict[i,j+1] + F(i,j,i,j+1),
| |                 Pict[i−1,j+1] + F(i,j,i−1,j+1),
| |                 Pict[i,j]
| |    if (Pict[i,j] <> temp) changes = right
| end of loop on i
end of loop on j
end as long_as.
```

We claim:

1. A method of exploring a heterogeneous geological original reservoir by means of a transposed reservoir equivalent to the original reservoir with respect to a determined type of physical transfer function known for the original reservoir, said method comprising the steps of:

(a) analyzing the original reservoir to acquire data as to physical characteristics of the original reservoir, (b) forming a two-dimensional image of the original reservoir as a array of pixels, based on the acquired data;

(c) associating with each pixel of the array an initial value for the physical transfer function, (d) assigning a value for the physical transfer function at each pixel of said array, by reference to values of the function assigned to neighboring pixels of the image;

(e) determining a physical property of the transposed or equivalent reservoir by identifying a volume portion of the equivalent reservoir based on the physical transfer function for the corresponding volume portion of the original reservoir; and (f) physically exploring the original reservoir based on the determined physical property.

2. A method as claimed in claim 1, wherein the heterogeneous geological reservoir is crossed by an irregular network of fractures all geometrically defined in blocks of irregular shapes and dimensions.

3. A method as claimed in claim 1, wherein the physical transfer function represents the distance between different parts of the geological original reservoir.

4. A method as claimed in claim 1, wherein the physical transfer function represents transmissivities between different parts of the geological original reservoir.

5. A method as claimed in claim 1, wherein the physical transfer function represents heat transfer between different parts of the geological original reservoir.

6. A method as claimed in claim 1, wherein the physical transfer function represents mass flow transfer between different parts of the geological original reservoir.

7. A method as claimed in claim 2, wherein:

the transposed reservoir includes a set of regularly disposed blocks separated by a regular grid of fractures;

the transposed reservoir provides substantially the same recovery function (Req) of a fluid during a capillary imbibition process as the original reservoir;

the physical transfer function represents the minimum distance separating each pixel from the nearest fracture;

step (d) comprises forming a distribution of the pixel numbers versus distance to the different fractures, and determining therefrom the recovery function (R) of said set of blocks; and step (e) comprises determining dimensions (a,b) of the equivalent regular blocks of the set from the recovery function (R) and from the recovery function (Req).

8. A method as claimed in claim 5, wherein the physical transfer function represents heat transfer between the reservoir and a well crossing the reservoir.

* * * * *